US006122828A

United States Patent [19]

Asterino, Jr.

[11] Patent Number: 6,122,828

[45] Date of Patent: Sep. 26, 2000

[54] RETRACTABLE BLADE KNIFE AND CUTTING EDGE

[76] Inventor: William M. Asterino, Jr., 26 Dressage Dr., Sewell, N.J. 08080

[21] Appl. No.: 09/360,950

[22] Filed: Jul. 27, 1999

[51] Int. Cl.[7] ..... B26B 3/06; B26B 29/00; B26B 9/02

[52] U.S. Cl. ..... 30/151; 30/286; 30/295; 30/298; 30/357

[58] Field of Search ..... 30/151, 162, 286, 30/289, 290, 291, 298, 295, 346, 353, 357

[56] References Cited

U.S. PATENT DOCUMENTS

| | | | |
|---|---|---|---|
| D. 301,048 | 5/1989 | Hollinshead . | |
| 829,353 | 8/1906 | Rand . | |
| 1,181,681 | 5/1916 | Nicaud | 30/151 |
| 1,322,775 | 11/1919 | Fallon . | |
| 1,426,085 | 8/1922 | Kohn | 30/346 |
| 1,455,621 | 5/1923 | Joyner | 30/298 |
| 1,896,580 | 2/1933 | Gilmore | 30/151 |
| 2,249,631 | 7/1941 | Kershenstein | 30/286 |
| 2,359,098 | 9/1944 | Engle . | |
| 2,367,945 | 1/1945 | Jorgensen | 30/286 |
| 2,555,735 | 6/1951 | Estabrooks | 30/357 |
| 2,741,025 | 4/1956 | Stewart . | |
| 2,760,266 | 8/1956 | Sanders | 30/357 |
| 4,096,629 | 6/1978 | Levine . | |
| 4,523,379 | 6/1985 | Osterhout et al. | 30/151 |
| 4,546,510 | 10/1985 | Harrison | 30/151 |
| 4,817,221 | 4/1989 | Ryan . | |
| 5,025,560 | 6/1991 | Townsend . | |
| 5,093,997 | 3/1992 | Gilman | 30/298 |
| 5,146,810 | 9/1992 | Mueller . | |
| 5,391,177 | 2/1995 | Schwartz . | |
| 5,697,835 | 12/1997 | Nitz et al. | 30/353 |

*Primary Examiner*—Hwei-Slu Payer
*Attorney, Agent, or Firm*—Robert A. Koons, Jr.; James W. Bolcsak; Pepper Hamilton LLP

[57] ABSTRACT

A retractable blade knife is described, which has a handle composed of two parallel members connected by biasing spring assemblies and a blade orthogonal to the handle members. A cutting edge comprising cutting segments connected at varying angles to one another is disclosed, the cutting edge providing a visual effect similar to a flaked cutting edge.

20 Claims, 8 Drawing Sheets

RETRACTABLE BLADE KNIFE AND CUTTING EDGE

FIELD OF THE INVENTION

The present invention relates to retractable blade knives. In particular, the retractable blade knife of the present invention relates to a knife providing a blade that is protected within a handle when the blade is not in use, and where the handle is orthogonal to the blade. The invention also provides a new cutting edge for knives that presents a series of cutting segments that are at angles with respect to adjacent cutting segments, where the angles vary over a range of values within a series of cutting segments on a blade.

BACKGROUND OF THE INVENTION

Knives with mechanisms for protecting the knife blade when not in use are known. Some of these knives are of a folding variety, with a blade that pivots from an open position to a folded position where the blade is protected within an opening in the knife handle. Another variety of protecting mechanism allows for retraction of the knife blade. In this variety the knife blade can be moved from an open position which has the blade extended from the knife handle, to a closed position which has the blade disposed within an opening within the knife handle, and where the movement of the knife is substantially linear. An example of the first variety of knife is the common folding pocketknife. An example of the second variety is the common utility knife.

These knives have limitations in their use however, because they are basically gripped in the same manner. There remains a need in the art for a convenient, retractable knife that is comfortable to hold and use, and yet is suitable for cutting uses such as those for which utility knives are used. Knives are known that have blades which are substantially in line with the knife handle. Although these knives are suited to some cutting tasks, other cutting tasks are accomplished more readily with knives having blades at an angle to the knife handle. A need exists in the art for a knife that can be held in positions other than with the knife blade extending from the axis defined by a clenched fist. For cutting a sheet material such as linoleum for example, it is common to use a knife having its blade at an angle other than zero degrees to its handle. This angle allows the knife blade to be pulled through linoleum while clearance for the user's knuckles above the surface of the floor is provided. Thus, some cutting tasks are better suited to a knife with a blade in a different orientation than that found in common knives. That is, some cutting tasks would be more easily accomplished with a knife whose cutting edge would be presented in a particular orientation with respect to the hand holding the knife. Fatigue to the hand being used to hold the knife can be avoided, and safety of use can result from such a change in orientation of the blade. In particular a need exists in the art for a knife that has a blade orthogonal to the knife handle. A need also exists in the art for a knife having a blade orthogonal to its handle, and whose knife blade is also retractable. The retractable blade knife of the present invention as described herein meets these needs.

As disclosed in U.S. Pat. No. 2,359,098 to Engle, a knife is known that has a blade that is orthogonal to its handle. The blade arrangement taught in this patent does not provide for retraction of the blade, although it does provide a mechanism for adjustment to the size of a user's hand. The blade of the knife taught in this patent is always exposed, there being no retraction mechanism. The use of a knife as taught in this patent has a potential safety problem for a careless user. The knife as taught by the present invention addresses this problem by providing for retraction of its blade.

U.S. Pat. No. 1,322,775 to Fallon discloses a bladed military weapon whose blade is held in line with a user's forearm, and orthogonal to the axis of the user's clenched fist. This weapon is taught as having an extension that grips the forearm of the user. This weapon is taught as having a pivoting mechanism for the blade that allows the blade to be pivoted from a service position to a folded position above the forearm. The arrangement taught by Fallon does not provide any structure that receives a blade to protect a user against accidental cuts. Also, the weapon as taught by Fallon does not provide any means for retracting the blade of the weapon.

U.S. Pat. No. 5,025,560 to Townsend discloses an ergonomic knife that has a blade that is held orthogonal to a clenched fist of a user when in use for cutting. This knife also has a mechanism for pivoting the blade into a range of cutting positions relative to an extended support member that reaches part way up the forearm and is attached to the forearm of a user. For use, the knife disclosed requires attachment to the forearm, which can be an inconvenience and shortcoming in use. Another shortcoming is that the knife as taught by Townsend has no mechanism for retraction of its blade to a protecting position that would protect a user from accidental cuts.

Another knife having a blade orthogonal to its handle as used was disclosed in United States Design Patent D301,048 to Hollinshead. This particular knife design teaches a knife whose blade is not retractable. The blade of this knife does not extend directly to the handle, but is attached to the knife handle with two blade extension members whose attachment point to the handle are spaced apart by at least two finger widths. This knife also lacks a mechanism for retraction of its blade.

U.S. Pat. No. 4,096,629 to Levine discloses a claw weapon that has multiple retractable blades. This claw weapon has blades that while in use, project outwardly between adjoining fingers of a user's hand. The claw weapon comprises a tubular grip member that contains the blades when the blades are in a retracted position. As taught in the Levine patent, the fingers of a user are in very close proximity to the cutting edges of the multiple blades. An inadvertent shifting of the fingers of a user could expose the fingers to cuts from the blades as such a weapon is being used. This is a serious shortcoming with a weapon according to this teaching. The weapon taught by this patent also lacks a locking mechanism for retaining its blades in an extended position.

U.S. Pat. No. 2,741,025 to Stewart discloses a weapon having a pointed dagger element fixed orthogonal to a gripping member; and also having a tubular sheath of soft elastic material disposed around the dagger element, for protecting a user from the pointed dagger element in storage and for slidably exposing the dagger element in use as a weapon. This weapon does not have a blade. The use of a soft elastic sheath as taught by Stewart would be impractical with a knife blade having edges along the blade's length, because the sheath would be expected to be cut by the knife edges during handling and damaged, if pressure were brought to bear on the sides of the soft elastic sheath. Moreover, the use of a soft elastic material for a sheath around a knife blade would expose the fingers of a user to cuts if the fingers should push against the soft material. These are shortcomings for the weapon as taught by Stewart.

A need exists therefore for a knife with a blade that is orthogonal to its handle, and where the blade is also retractable. A need also exists for this blade to be easily retractable without binding of the retraction mechanism. A further need exists for a knife with such an orthogonal, retractable blade where the blade can be locked in an extended position. Still another need exists for a retractable blade knife where the blade will be enclosed while retracted to protect the user, and where the blade while extended will avoid having a cutting edge in close enough proximity to the fingers of a user to endanger the fingers.

As shown in *A. G. Russell Catalog of Knives Spring* 1999, p. 51, April, 1999, knives with blades having an irregular edge are known. Such blades appear to be made of materials that are easily fractured and flaked, such as flint or obsidian. These knives with an irregular edge have been used for many years and have been found particularly useful for cutting some materials. These knives have blades that lack certain strengths such as the ability to bend and cut without breaking across the width of the blade however. This lack of certain strengths is a serious shortcoming for the knives with flint or obsidian blades. A need therefore exists for a blade with an edge that is similar to an irregular edge, but that is made of a metal and that can be reproducibly manufactured.

To overcome such shortcomings, a blade edge is disclosed here that provides a cutting edge somewhat similar in appearance to the irregular edge used on flint or obsidian blades, but that is also suited for use with a metal knife blade.

To overcome the shortcomings of known knives above, and to satisfy the outstanding needs outlined above I have now discovered a new retractable knife. I have also discovered a new knife edge that can be used with the new retractable knife, or with other knives or other cutting implements.

SUMMARY OF THE INVENTION

Briefly, the invention is a knife with a retractable blade where the blade is orthogonal to the knife handle. The new knife comprises a handle with two handle elements. One element is a palm gripping member. The other element is a finger gripping member that has a slot extending through it, and that is parallel to the palm gripping member. An elongated blade is fixed at one of its ends to the palm gripping member and the blade extends through the slot, the slot being sized to accommodate passage of the blade. A biasing, member having two ends is fixed at its first end to the palm gripping member, and is fixed at its second end to the finger gripping member. The biasing member is substantially orthogonal to both of the gripping members. The biasing member is also sized and shaped to receive the blade within the biasing member. That is, the biasing member surrounds the blade, or can hold the blade within itself. The blade is retractable from a first extended position to a second retracted position in response to biasing extension of the biasing member. A stabilizer bar, depending from the finger gripping member, slides in a longitudinal slot in the blade. The finger gripping member has at least two openings through it, the openings sized and shaped to receive fingers of a user. The finger openings are preferably spaced apart sufficiently to permit the blade passing slot and the blade to be disposed between the finger openings. This arrangement then ensures that the fingers of a user are separated from the blade by portions of the finger gripping, member.

Preferably, the biasing member comprises either one or two coiled springs. It is preferred that the biasing member have an oval transverse section for more readily accommodating the blade. The biasing member surrounds the blade in a retracted position, thereby protecting the user from accidental cuts.

A new cutting edge for use on knife blades is also disclosed here. By edge here is meant the region of a blade that is adapted for use as the cutting side of a blade. The new edge comprises a series of cutting segments along a blade. The cutting segments are each substantially linear, and are in end to end relationship for forming the edge. Each of the cutting segments is disposed at a selected angle of up to about 25 degrees from the line of a contiguous cutting segment. That is, when any pair of contiguous cutting segments is considered, one of the pair forms an angle of up to about 25 degrees with respect to the other of the pair. A cutting segment deviates from the line of a contiguous cutting segment up to about 25 degrees however with the proviso that the overall width of the blade edge so formed is no more than about 3 mm (millimeters). In effect then, the cutting edge of the invention is made up of a series of very small edge portions, the cutting segments. The visual effect of this arrangement when viewed from the plane of the blade is that of a meandering edge, having the general appearance of a flint knife's edge. The visual effect when viewed from the side of the blade is also that of a meandering edge with this same general appearance.

The new knife edge can have these cutting segments each sharpened to present a bevel such as is commonly found on the blades of ordinary knives. Preferably, the edge comprises cutting segments with two substantially parallel opposed sides and a face distal from the blade body that supports the cutting edges. The preferred length of the cutting segments is from about 0.2 mm to about 1 cm (centimeter), and the preferred thickness between the opposed sides is from about 0.5 mm to about 1.5 mm and is most preferred to be about 1 mm.

The form of the new knife edge can be used on a particular knife blade by itself or in combination with a conventional edge such as a bevel. That is, an edge of a particular knife may be divided into regions, one region of which has a conventional bevel, and the other region of which is composed of the end to end cutting segments as disclosed herein. A particular knife may also have an edge that is divided into two regions where one region has a conventional serrated edge profile, and the other region is composed of the end to end cutting segments disclosed herein.

The new knife edge can also have cutting nodules distributed along the cutting segments, where the cutting nodules are pieces of a material that is sufficiently hard to resist being readily worn down during use of the knife edge, and where the cutting nodules project from the cutting segments. Preferably, the nodules are substantially hemispherical in overall shape and have a sharp, jagged, irregular surface texture for providing a component of abrasion to the cutting effect of the edge. The nodules may be made of a metal or a ceramic material. If made of a metal, the metal may be the same as that used for the rest of the blade or a different metal may be used.

A knife according to the present invention can have one blade edge that was ground to present a conventional bevel, and can have a second blade edge with the latter being the inventive knife edge comprised of the cutting segments in end to end relationship at varying angles to one another. An advantage to having both the inventive knife edge and a conventional bevel edge in a single knife blade is that a user can select whichever cutting edge is best suited to a given cutting task at hand. The knife according to the present invention can be rotated in the user's hand to allow the selection of the better of two cutting edges for the given task.

It is accordingly an aspect of the invention to provide a retractable blade knife where the blade is orthogonal to the handle.

It is another aspect of the invention to provide a retractable blade knife having a biasing member that biases the blade to a retracted position.

It is another aspect of the invention to provide a retractable blade knife with a locking mechanism that allows the blade to be locked in an extended position.

It is yet another aspect of the invention to provide a new cutting edge for use on knives and other cutting tools, where the new cutting edge has characteristics of a meandering edge for aggressively cutting difficult materials.

It is yet another aspect of the invention to provide a new manmade cutting edge for use on knives and other cutting tools, where the new cutting edge roughly imitates the overall appearance of a flaked stone knife, but which is distinguished by having distinct and well defined dimensional constraints for a series of cutting segments.

It is still another aspect of the invention to provide a retractable blade knife that comprises the new cutting edge.

These aspects, and others set forth more fully below are achieved by the present invention. In particular, a new knife is disclosed that reduces fatigue for the user, has a retractable blade, can provide an optional locking mechanism for the blade, and that preferably has an inventive blade for providing aggressive cutting action.

DETAILED DESCRIPTION OF THE INVENTION

I have developed a new and improved retractable blade knife, well suited for use as a utility knife. I have also developed a new and improved cutting edge for use on knives and other cutting implements. The knife and cutting edge will be understood more clearly by reference to the accompanying drawings.

Figure 1:
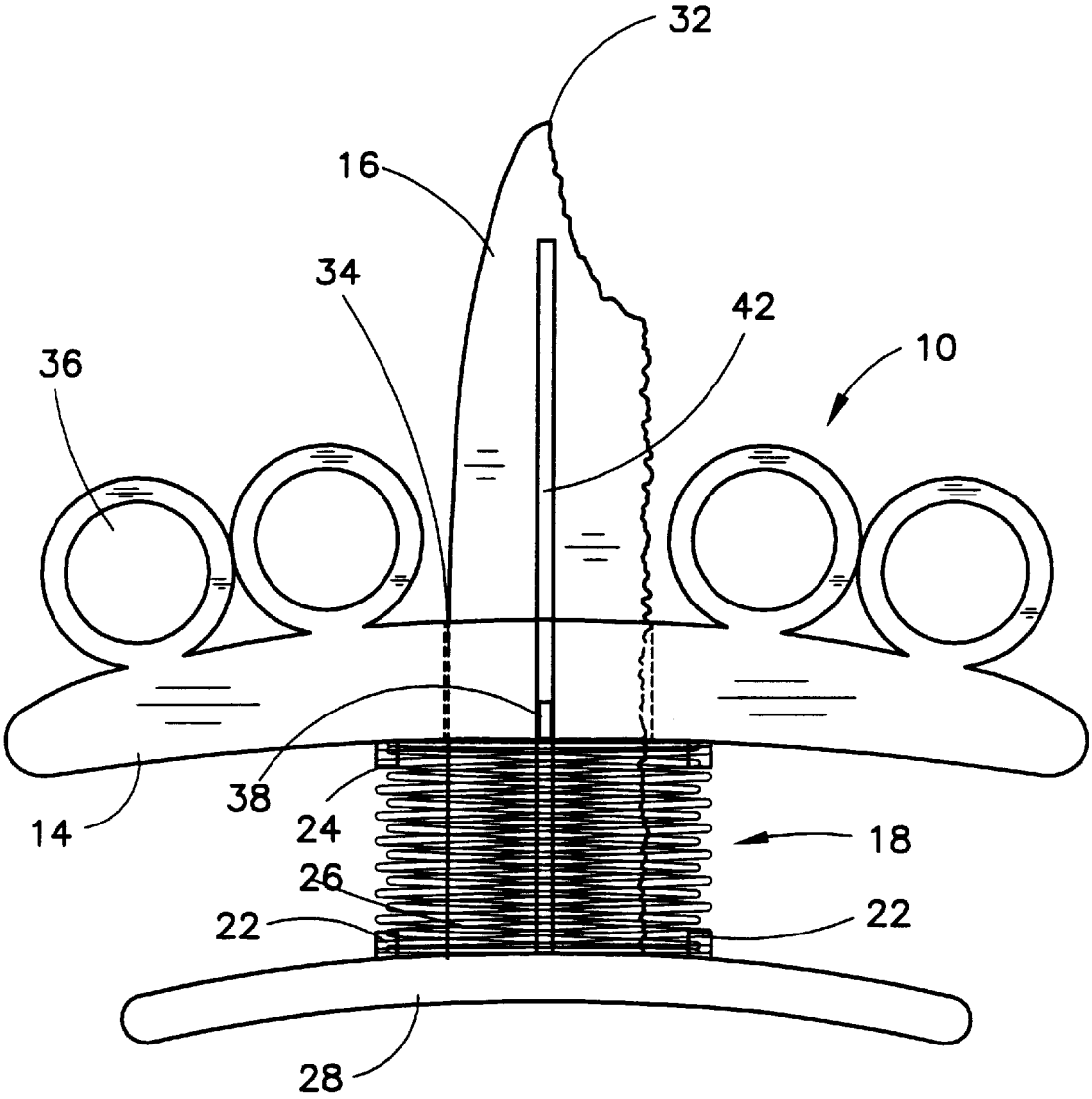
FIG. 1 is an illustration of a front elevation view of a first embodiment of a knife according to the invention, with the blade in an extended position.

With reference to these drawings, wherein like reference numerals designate similar parts throughout the various views, 12 designates the palm gripping member of the knife embodiment 10 depicted in FIG. 1. The number 14 designates the finger gripping member, and 16 designates the blade. A biasing member 18 connects the palm gripping member 12 and finger gripping member 14. The biasing member 18 is orthogonal to the palm gripping member 12 and fastened to it by a pair of stays 22. The biasing member 18 is orthogonal to the finger gripping member 14 as well, and is fastened to it by a pair of stays 24. The blade 16 has a first end 26 fastened to the palm gripping member 12 at region 28. The second end 32 of the blade 16 extends through a slot 34 through the finger gripping member 14. The finger gripping member 14 for the embodiment shown has four openings 36 for receiving fingers. It is to be understood that the finger openings 36 could be merged into three or into only two finger openings of appropriate dimensions without losing their function as gripping points for fingers of a user. It is also to be understood that the finger openings 36 could be arranged at various angles to make a particular user's grip more comfortable without deviating from the teachings of the invention.

The finger gripping member 14 comprises a stabilizer bar 38 that depends from a side of the finger gripping member 14 into the slot 34 through the member 14. the blade 16 has a longitudinal slot 42 mortised into it that is dimensioned to receive and slidably engage the stabilizer bar 38 for motion within the slot 42.

The biasing member 18 in the embodiment shown comprises a pair of coiled springs, having oval cross sections, the springs being coaxial and intertwined. The biasing member 18 is shown in more detail in an end view, showing a preferred oval shape, in FIG. 7. As shown, the two springs are coils with opposite handedness, one being right handed and one being left handed. In FIG. 8 can be seen an elevation view of the two springs, 52 and 54, that make up the biasing element 18. Other arrangements of springs are also to be recognized as suitable for practicing the invention such as a pair of springs which are coaxial, but of slightly different diameters. This particular alternate arrangement provides a spring that can fit into the cavity of the second spring while the springs still have a common axis. Constant force springs are known in the art and are also to be recognized as capable of use in the inventive knife.

It is to be understood that the biasing member 18 can comprise a single coiled spring of appropriate size and shape. It has been found however that two coiled springs as shown in FIG. 1 and FIG. 8 are preferable for the smooth operation of a knife according to the teaching of the invention.

The openings 36 through the finger gripping member 14 may be sized, shaped, angled and positioned at various locations in the finger gripping member to allow fingers of various sizes to conveniently grip the new knife. For example, two oval openings (not shown) can be substituted for the four openings shown, each oval opening accommodating fingers. This latter arrangement is to be considered as still within the teaching of the present invention. By having the user's fingers received within the openings of the finger gripping member, protection from the blade edges is afforded to the fingers by the separation of the fingers from the edges.

Figure 2:
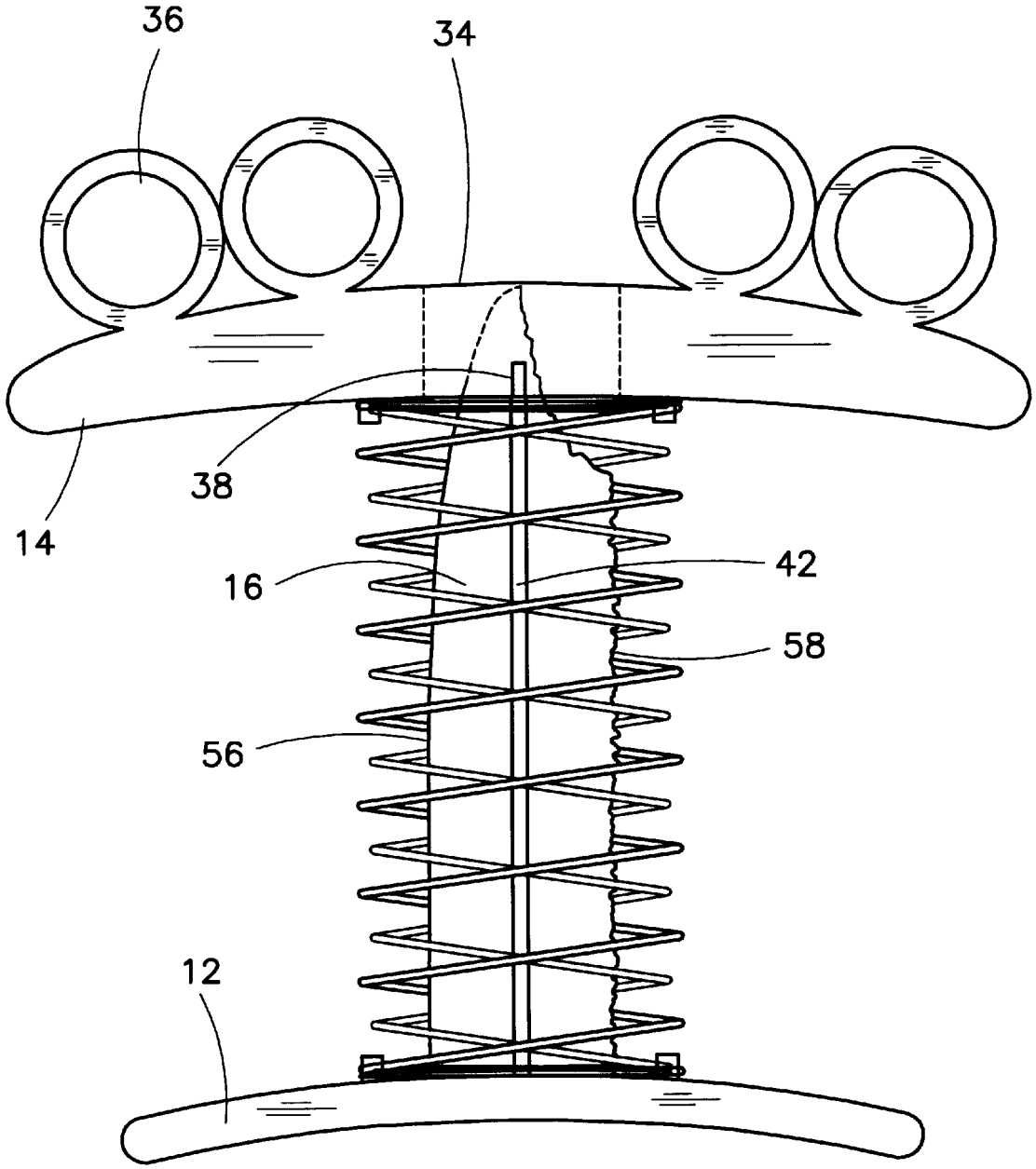
FIG. 2 is an illustration of a front elevation view of the first embodiment, with the blade in a retracted position.

In FIG. 2 may be seen the knife embodiment of FIG. 1, where the knife is in a retracted position. By relaxing the user's grip on the knife, the biasing element 18 is allowed to urge the finger gripping and palm gripping members 14, 12 to become spaced apart. This allows the biasing member 18 to surround the blade 16. The user's hand is thereby protected from the first edge 56 and second edge 58 of the blade. It is preferable that the inventive knife 10 be dimensioned so that when the biasing element 18 is fully extended, the blade 16 will be fully retracted into the biasing element 18 and the second end 32 of the blade 16 will be enclosed within the biasing element 18.

The blade 16 has a longitudinal slot 42 mortised into it that receives a stabilizer bar 38 that depends from the finger gripping member 14. The length of the longitudinal slot 42 may be selected to limit the spacing apart of the finger gripping member 14 and palm gripping member 12 that is achieved by the biasing member's extension.

Figure 3:
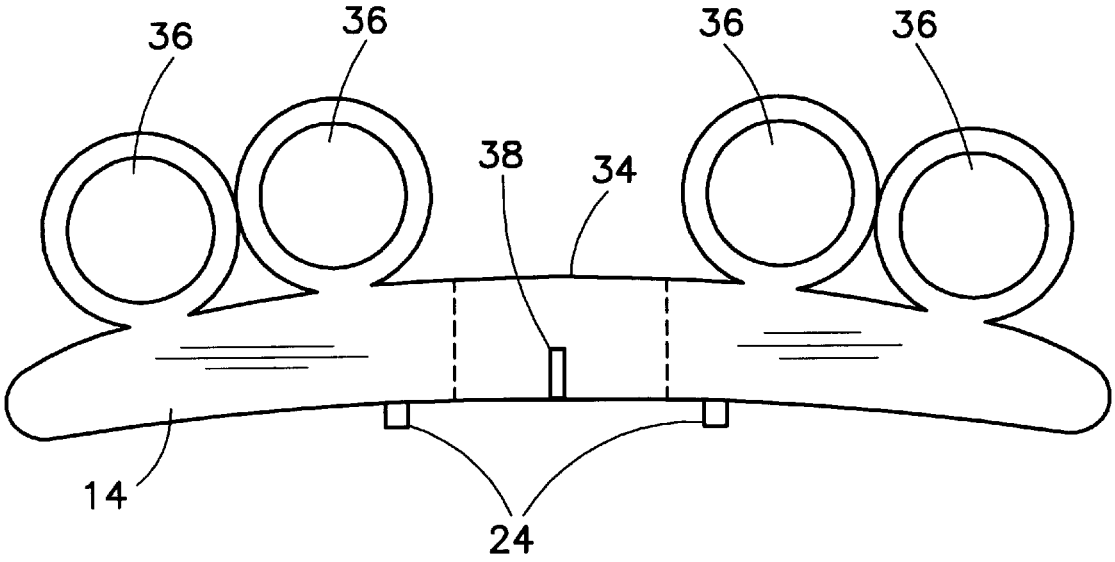
FIG. 3 is an illustration of a front elevation view of a finger gripping member of the first embodiment.

FIG. 3 depicts a finger gripping member 14 and shows more clearly the stays 24 that may be used to fix the biasing member 18 to the finger gripping member 14. Also shown is the stabilizer bar 38 that depends from the finger gripping member 14 into the slot 34.

Figure 4:
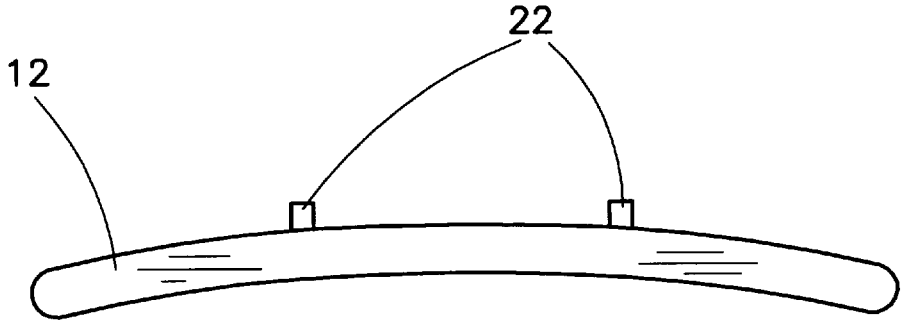
FIG. 4 is an illustration of a front elevation view of a palm gripping member of the first embodiment.

In FIG. 4 may be seen a palm gripping member 12 and the stays 22 that are used to fix the biasing member 18 to it.

Figure 5:
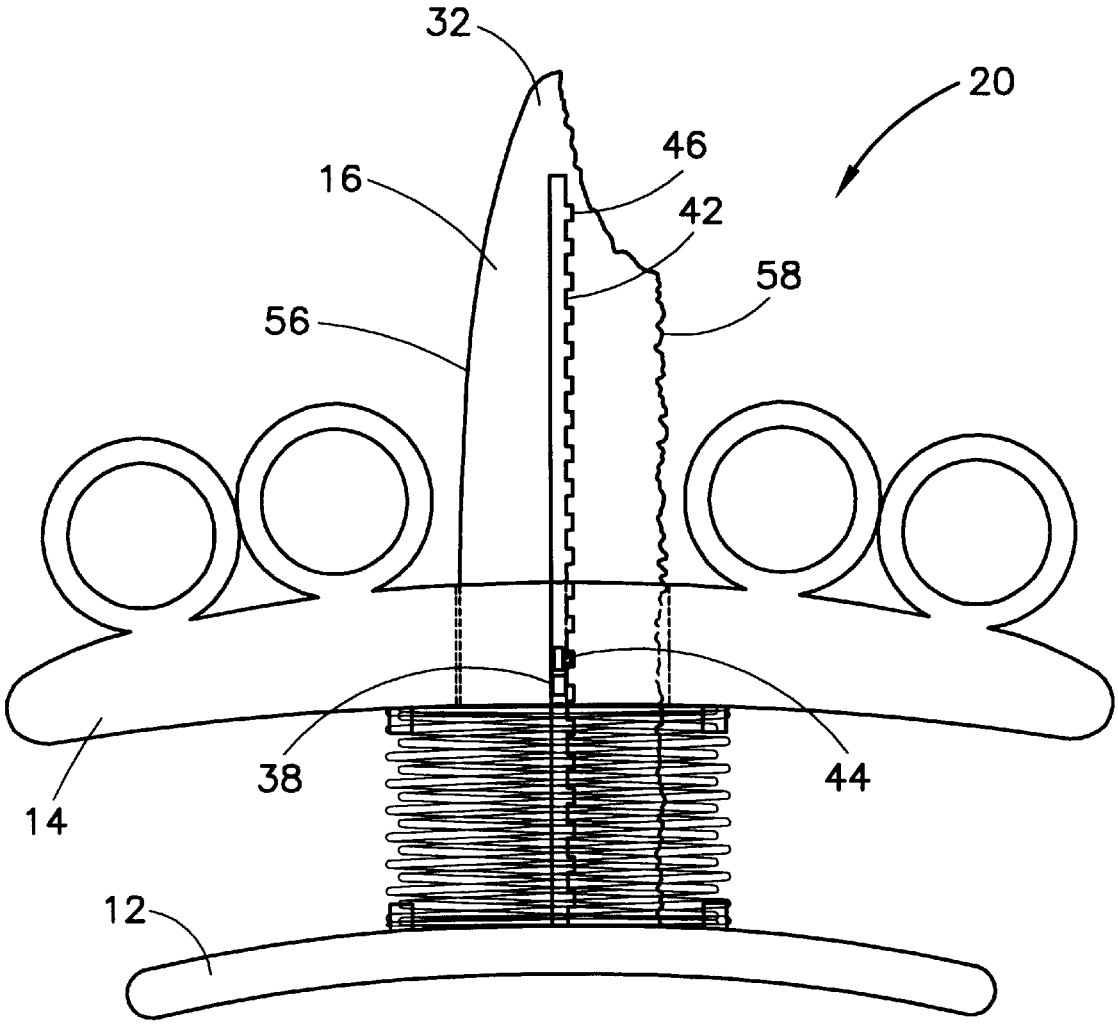
FIG. 5 is an illustration of a front elevation view of a second embodiment of a knife according to the invention, this embodiment having a locking mechanism.

Turning to FIG. 5, an alternate embodiment 20 of the inventive knife may be seen. The construction of this embodiment is similar, but this embodiment further comprises at least one transverse slot 46 in the blade, and a locking member 44 that is disposed along the finger gripping member 14 and that is adapted for removably engaging with the transverse slot 46. This engagement restricts the sliding motion of the blade 16 through the slot 34, and retains the blade 16 in a selected position. Proper positioning of at least one transverse slot 46 in proximity to the first end 26 of the blade 26 allows the user to lock the blade in the extended position for use in cutting. Positioning of at least one additional transverse slot 46 in proximity to the second end 32 of the blade allows the user to lock the blade 16 in the retracted position. The shape of the locking member 44 is not critical to the operation of the knife 20 as long as it can be removably engaged with the slot 46 by being closely received within the slot 46.

Figure 6:
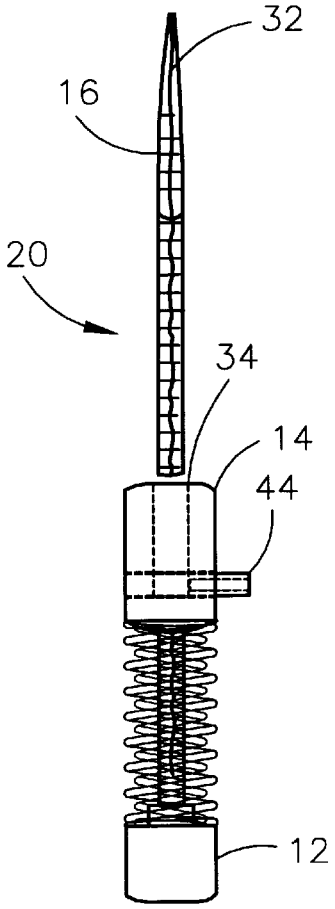
FIG. 6 is an illustration of an edge elevation view of the second embodiment.

FIG. 6 depicts an edge elevation view of the embodiment 20 seen in FIG. 5. The locking member 44 may be seen more clearly there.

The knife of the present invention can be made with conventional bevel edges on the blade. A conventional serrated edge or a conventional saw tooth edge can also be used on the blade. It is preferred that the inventive knife have at least one edge of a type that is disclosed herebelow. The embodiments shown in FIG. 2 and FIG. 5 are depicted with their blades having a first edge 56 with a conventional bevel, and having a second edge 58 with an edge of the type disclosed here.

Figure 9:
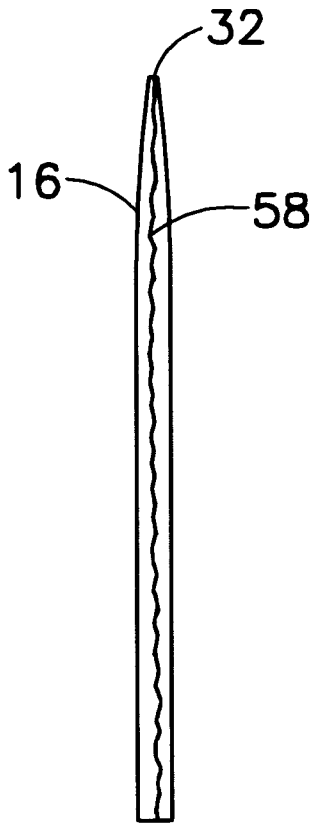
FIG. 9 is an illustration of an edge elevation view of a blade according to the invention.

A new edge design has been discovered that is superior to those hitherto known for cutting certain kinds of materials. An edge elevation view of the blade 16 is illustrated in FIG. 9. The inventive edge 58 consists of a series of nearly random, substantially linear cutting segments, segments 62 and 64 being examples of such segments. These segments may vary in length and form the blade edge 58 by the segments being oriented in end to end relationship, where the angle a first segment deviates from the line of a second segment can vary substantially at random up by to about 25 degrees. That is, a pair of contiguous segments forms an angle that can be as large as about 25 degrees. The length of the cutting segments can vary substantially at random from about 0.2 mm to about 1 cm. The cutting segments then meander from the plane of the blade and within the plane of the blade.

Figure 10:
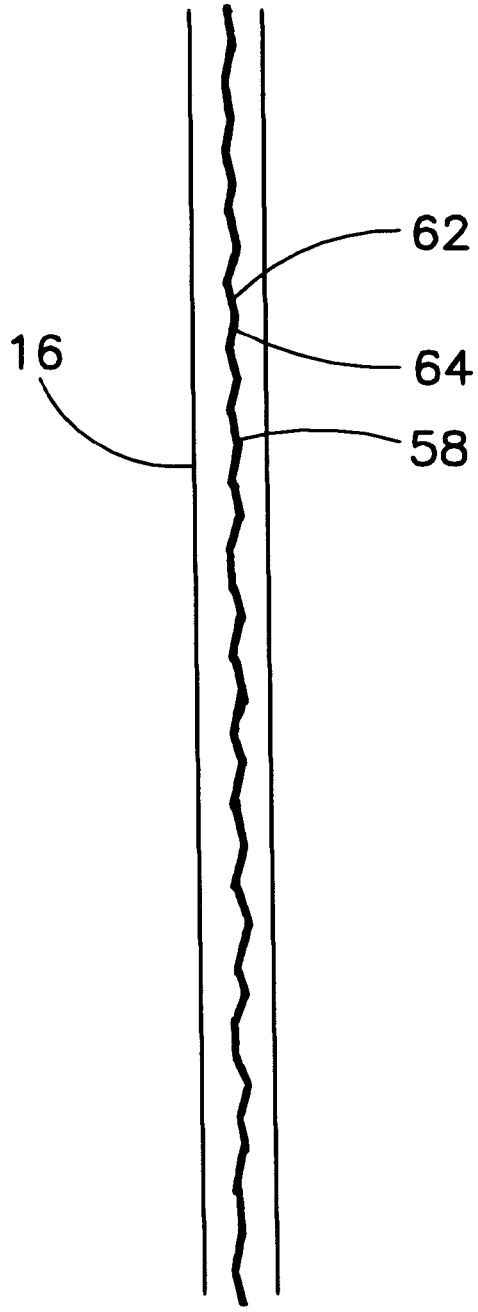
FIG. 10 is an illustration of an enlargement of a section of FIG. 9, showing details of the blade edge according to the teaching of the invention.

The edge formed from such a series of cutting segments can have each cutting segment formed into a bevel edge. An edge embodiment as so described will effectively be composed of a series of very small "bladelets" which can be viewed as forming a meandering path down the blade as a whole. In FIG. 10 may be seen an example of such an edge. The cutting edge is seen as twisting from side to side along the blade, but the inventive edge is formed with the proviso that the maximum width of the edge is up to about 3 mm.

Figure 11:
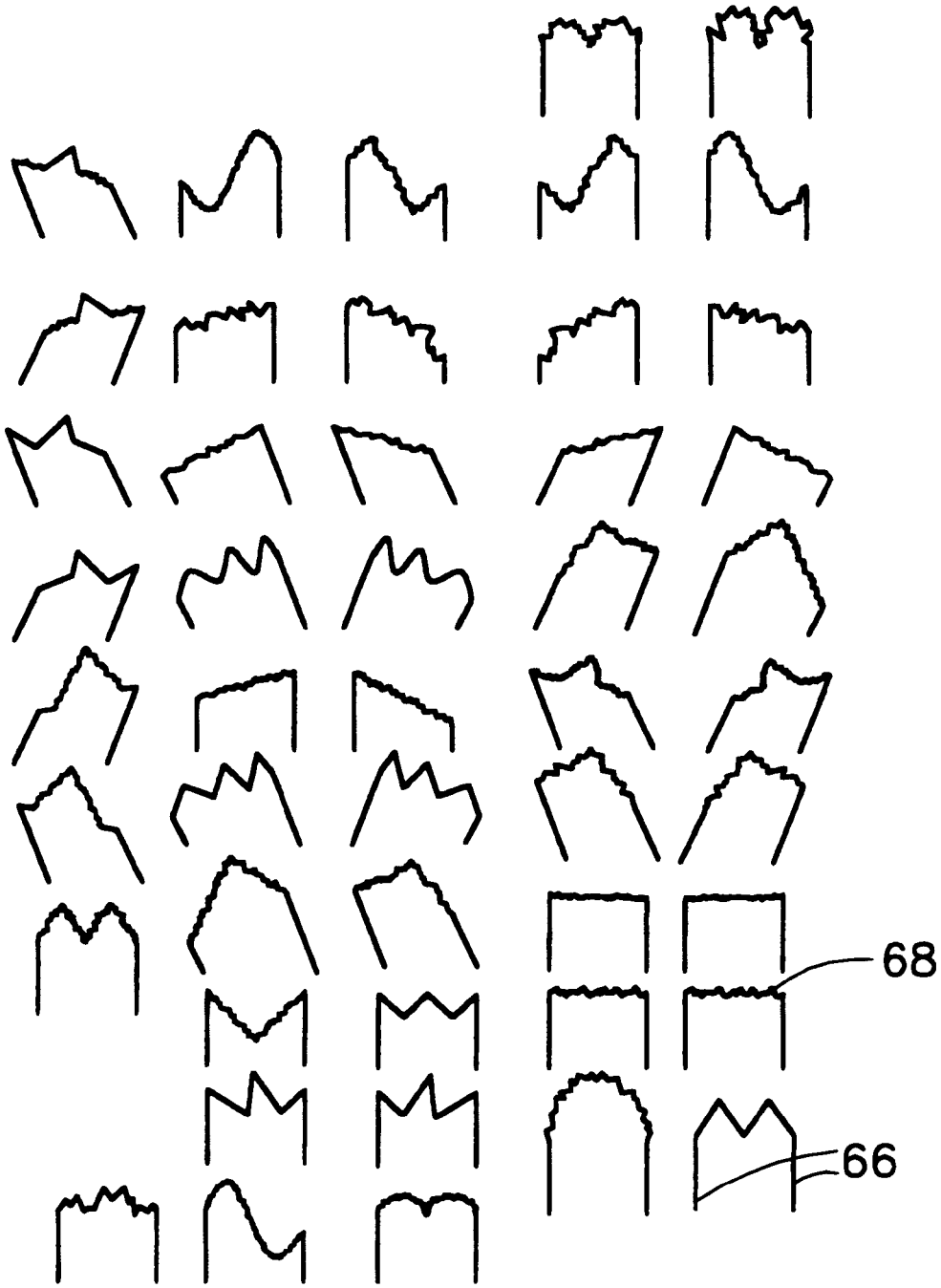
FIG. 11 is an illustration of a set of possible edge profiles for cutting segments according to the teaching of the invention.

In a preferred embodiment, the inventive edge comprises cutting segments where each cutting segment is also of 0.2 mm to 1.0 cm in length, and where the angle each cutting segment deviates from the line of a contiguous cutting segment varies substantially at random to about 25 degrees. And, in addition, the cutting segments have two substantially parallel opposed sides 66 and a face 68 distal the supporting blade, provided that the thickness of each of the cutting segments is about 1 mm. The distal face may have a jagged, irregular profile. In FIG. 11 are illustrated examples of the possible jagged, irregular profiles that can be encompassed by the design of the inventive blade. The parallel opposed sides 66 are referenced for one of the examples shown, and the distal face 68 is referenced for another example. By "jagged, irregular" is meant that the profile of each cutting segment varies substantially randomly in height and shape over the face of the profile, in a direction normal to the distal face.

The cutting segments may form a regular repeating pattern to make up a cutting edge, however it is preferred that the cutting segments not form a regular repeating pattern in forming a cutting edge. That is, the set of cutting segments used for a given knife edge should present to the eye of a user an irregular pattern. If a regular repeating pattern of cutting segments is present, the pattern should repeat over a distance sufficiently long to not have the repetition readily apparent to a viewer without close inspection. In this latter case, the appearance of irregularity will be present. The inventive cutting edge is not completely irregular however, but is distinctly described by the limitations disclosed here.

A more highly preferred embodiment of the inventive edge for cutting is similar to the one just disclosed above, but farther comprising cutting nodules disposed along the edge. It is preferred that these cutting nodules be substantially hemispherical in shape and from about 0.05 mm to about 0.4 mm in diameter.

The cutting nodules should have a sharp, jagged, irregular surface. The cutting nodules may be made of the same material as the bulk of the blade, such as a steel, titanium, tungsten carbide, or a metal alloy containing either iron, titanium or tungsten. Alternatively, the cutting nodules may be made of a ceramic material.

Figure 12:
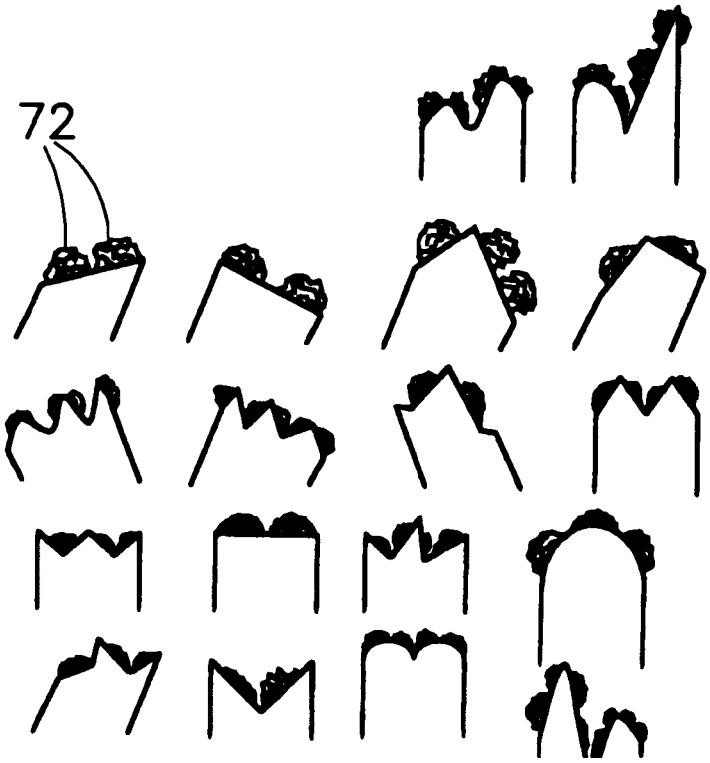
FIG. 12 is an illustration of a set of possible edge profiles according to the teaching of the invention, having cutting nodules disposed along the edge.
Figure 13:
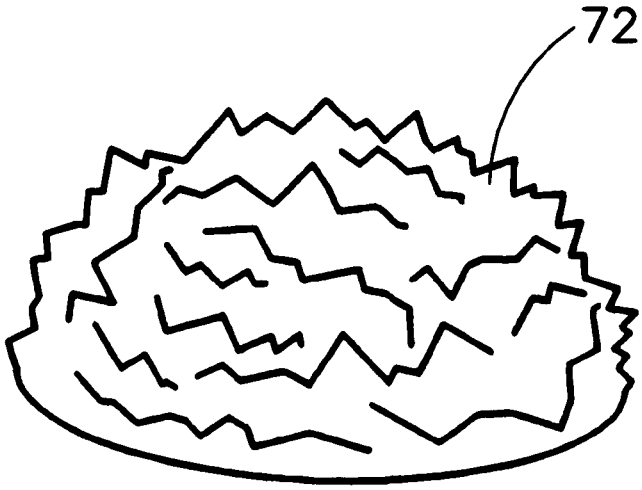
FIG. 13 is an illustration of the elevation view of a cutting nodule according to the teaching of the invention.

FIG. 12 illustrates examples of profiles for cutting segments which are encompassed by the invention, where the cutting segments have disposed along them cutting nodules 72. FIG. 13 illustrates the type of cutting nodule 72 suited for use with the present invention, having a sharp, jagged, irregular surface. The nodules selected for use in practicing the invention should have sharp surfaces, suitable for use as an abrasive. The quantity of nodules that should be used on a given blade edge may be selected by a manufacturer according to the type of material to be cut and the cost associated with the addition of nodules to the blade.

A knife edge with the structure disclosed here will be useful for aggressive cutting of a variety of materials usually found difficult to cut with conventional knife edges, and will have the advantage of a pleasing appearance that suggests irregularity to a viewer of the knife edge while not being completely irregular.

The palm gripping member, finger gripping member, and spring stays of the device are preferably constructed of plastic, wood, or metal. The blade can be made of a steel, but is preferably constructed of a metal such as tungsten carbide. The spring is preferably constructed of steel. A blade according to the teaching of the invention is preferably made by a casting process, as would be known to one skilled in the art of metal casting. The edges of the blade can also be ground using a conventional knife sharpening method to provide a conventional cutting edge.

Conventional knives use blades with an edge that is usually sharpened to present a thin bevel section for cutting, uniform along the length of the blade. Some blades have been used that have a serrated edge, where the edge has been ground in a regular series of scallops. A blade with such serrations or scallops can be more aggressive for cutting than a straight edge. This increased aggression presumably occurs because the edge is effectively made up of a linear array of very small blades, and using such a blade subjects the workpiece to be cut with many small blades that attack the workpiece at different angles. Irrespective of any theory of cutting, knives with a serrated edge are frequently viewed as more efficient cutting tools than knives with a straight edge.

In the present invention, a blade is disclosed that has advantages over a blade with a conventional serrated edge, or a conventional saw tooth edge. In particular, it has now been discovered that by having a blade edge composed of an array of cutting segments that twist and turn at varying angles as viewed down the edge of the blade, a knife is provided with an edge that can cut more efficiently through some materials than can conventional serrated edges.

It has also been discovered that the inventive cutting edge is improved substantially for use in cutting certain materials by having sharp, jagged, irregular distal surfaces and by having the cutting nodules described here distributed along the cutting edge.

It is to be understood that the blade used in the knife of the present invention may be permanently fixed to the palm gripping member, or may be removably fixed. In the latter case, the knife may be adapted to utilize user replaceable blades.

The present invention is not to be limited in scope by the embodiments disclosed herein, which are intended as single illustrations of one aspect of the invention, and any which are functionally equivalent are within the scope of the invention. Indeed, various modifications of the invention, in addition to those shown and described herein, will become apparent to those skilled in the art from the foregoing description. Such modifications are intended to fall within the scope of the appended claims. All patents and any publications mentioned herein are hereby incorporated by reference.

I claim:

1. A retractable blade knife, comprising:

a palm gripping member, dimensioned for gripping by a user against the user's palm;

a finger gripping member, disposed parallel to and forward of the palm gripping member, the finger gripping member having at least two openings therethrough dimensioned for receiving fingers of a user, and having a slot extending through the finger gripping member and orthogonal to the finger gripping member, the slot dimensioned for passage of a cutting blade, and the finger gripping member comprising a stabilizer bar depending therefrom;

a biasing member having a first end and a second end, fixed at the first end to the palm gripping member and fixed at the second end to the finger gripping member, the biasing member being orthogonal to both the palm gripping member and the finger gripping member; and the cutting blade, having a longitudinal slot sized to receive the stabilizer bar for sliding motion in the longitudinal blade slot, the blade retractable from a first extended position to a second retracted position in response to biasing extension of the biasing member, the blade disposed through and coaxial with the biasing member, the blade having a first opposed end fixed to the palm gripping member, the blade having a second opposed end, and the blade having opposed first and second edges extending intermediate the opposed ends;

wherein at least one of the blade edges comprises a plurality of cutting segments disposed along the blade in end to end relationship, each of said cutting segments disposed at a randomly selected angle of up to about 25 degrees with respect to a contiguous cutting segment, the length of each of said cutting segments is from about 0.2 mm to about 1 cm; and wherein the blade is a metal casting.

2. The knife according to claim 1, further comprising a locking member disposed along the finger gripping member, and adapted for reversible motion from a first unlocking position to a second locking position, wherein in the second locking position the locking member engages with a transverse slot in the blade, the blade having at least one transverse slot.

3. A retractable blade knife, comprising:

a palm gripping member, dimensioned for gripping by a user against the user's palm;

a finger gripping member, disposed parallel to and forward of the palm gripping member, the finger gripping member having at least two openings therethrough dimensioned for receiving fingers of a user, having a slot extending through the finger gripping member and orthogonal to the finger gripping member, the slot dimensioned for passage of a cutting blade, and the finger gripping member comprising a stabilizer bar depending therefrom;

a biasing member having a first end and a second end, fixed at the first end to the palm gripping member and fixed at the second end to the finger gripping member, the biasing member being orthogonal to both the palm gripping member and the finger gripping member; and the cutting blade, having a longitudinal slot sized to receive the stabilizer bar for sliding motion in the longitudinal blade slot, the blade retractable from a first extended position to a second retracted position in response to biasing extension of the biasing member, the blade disposed through and coaxial with the biasing member, the blade having a first opposed end fixed to the palm gripping member, the blade having a second opposed end, and the blade having opposed first and second edges extending intermediate the opposed ends;

so that the finger gripping member prevents exposure of a user to the blade edges when in the retracted position and exposes the blade edges in the extended position.

4. The knife according to claim 3, wherein the biasing member comprises at least one coiled spring.

5. The knife according to claim 4, wherein the biasing member comprises two coiled springs, the two coiled springs being coaxial and concentric.

6. The knife according to claim 5, wherein the two coiled springs have oval transverse sections.

7. The knife according to claim 4, wherein the biasing member comprises two coiled springs, the two coiled springs being coaxial and intertwined.

8. The knife according to claim 7, wherein the two coiled springs have oval transverse sections.

9. The knife according to claim 4, wherein the at least one coiled spring has an oval transverse section.

10. The knife according to claim 3, further comprising a locking member disposed along the finger gripping member, and adapted for reversible motion from a first unlocking position to a second locking position, wherein in the second locking position the locking member engages with a transverse slot in the blade, the blade having at least one transverse slot.

11. The knife according to claim 10, wherein the biasing member comprises two coiled springs, coaxial, intertwined, and having oval transverse sections.

12. The knife according to claim 11, wherein at least one of the blade edges comprises:

a plurality of cutting segments disposed along the blade in end to end relationship, each of said cutting segments disposed at a randomly selected angle of up to about 25 degrees with respect to a contiguous cutting segment, the length of each of said cutting segments is from about 0.2 mm to about 1 cm, each cutting segment having two substantially parallel opposed sides and a distal face, provided that the thickness of each of the cutting segments is about 1 mm.

13. The knife according to claim 12, wherein the at least one of the blade edges further comprises a jagged, irregular profile on the cutting segment distal face, where the jagged, irregular profile on each cutting segment may be the same or a different profile.

14. The knife according to claim 13, further comprising a plurality of cutting nodules disposed along the cutting segments, wherein the cutting nodules are substantially hemispherical, have diameters of from about 0.05 mm to about 0.4 mm, and have jagged, irregular surfaces.

15. The knife according to claim 10, wherein at least one of the blade edges comprises:

a plurality of cutting segments disposed along the blade in end to end relationship, each of said cutting segments disposed at a randomly selected angle up to about 25 degrees with respect to a contiguous cutting segment, the length of each of said cutting segments is from about 0.2 mm to about 1 cm, each cutting segment having two substantially parallel opposed sides and a distal face, provided that the thickness of each of the cutting segments is about 1 mm.

16. The knife according to claim 15, wherein the at least one of the blade edges further comprises a jagged, irregular profile on the cutting segment distal face, where the jagged, irregular profile on each cutting segment may be the same or a different profile.

17. The knife according to claim 15, further comprising a plurality of cutting nodules disposed along each cutting segment distal face; wherein the cutting nodules are substantially hemispherical, have diameters of from about 0.05 mm to about 0.4 mm, and have jagged, irregular surfaces.

18. An edge for cutting, comprising:

a plurality of cutting segments disposed along a blade in end to end relationship, each of said cutting segments disposed at a randomly selected angle of up to about 25 degrees with respect to a contiguous cutting segment, the length of each of said cutting segments is from about 0.2 mm to about 1 cm, each cutting segment having two substantially parallel opposed sides and a distal face, provided that the thickness of each of the cutting segments is about 1 mm.

19. The edge for cutting according to claim 18, wherein the edge further comprises a jagged, irregular profile on the cutting segment distal face, where the jagged, irregular profile on each cutting segment may be the same or a different profile.

20. The edge for cutting according to claim 19, further comprising a plurality of cutting nodules disposed along the cutting segments, wherein the cutting nodules are substantially hemispherical, have diameters of from about 0.05 mm to about 0.4 mm, and have jagged, irregular surfaces.

* * * * *

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application as follows:

Column 2,
Line 58, insert --knife-- before "blade.".

Column 3,
Line 48, delete "," after "biasing".
Line 65, delete "," after "gripping".

Column 6,
Line 35, delete,"the blade" and insert --The blade --therefor.

Column 7,
Lines 41 and 42, delete "to the first end 26 of the blade 26 allows", and insert --to the first end of the blade 16 allows --therefor.

Column 8,
Line 53, delete "farther" and insert --further -- therefor.

Column 12,
Claim 12, Number 15, delete "claim 10," and insert --claim 3,--therefor.

Signed and Sealed this

Tenth Day of July, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

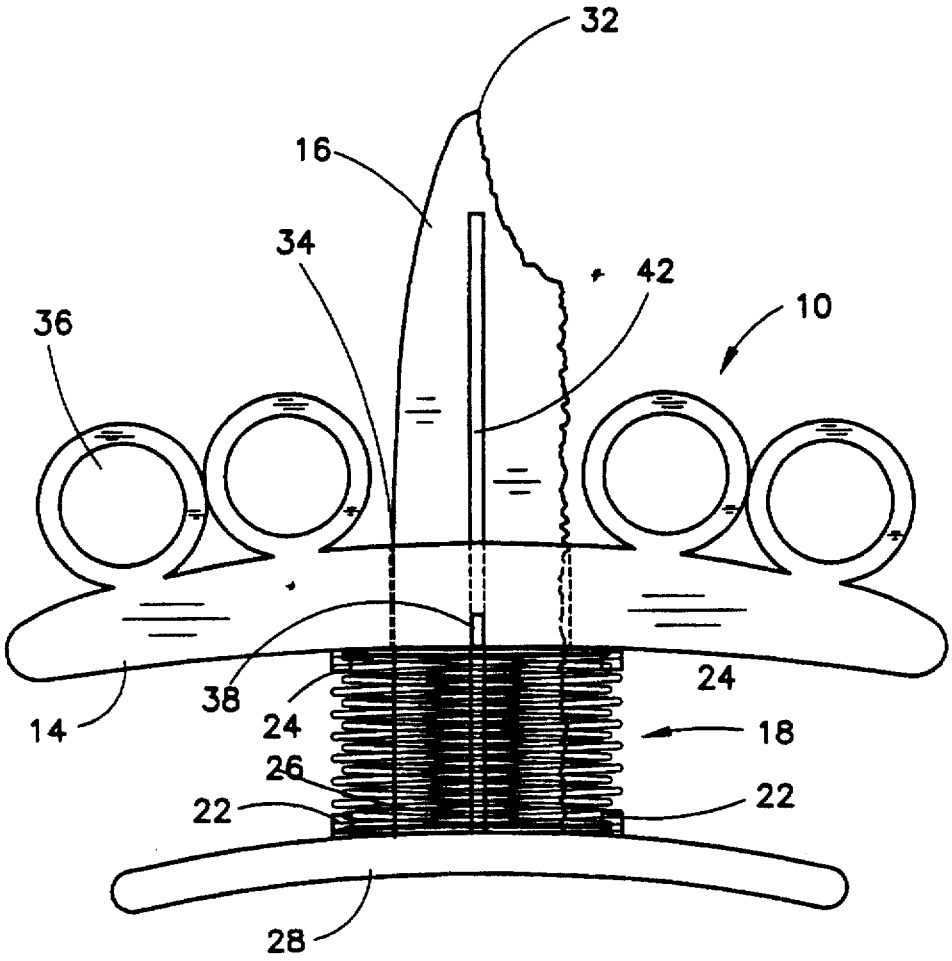

*Fig. 1*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

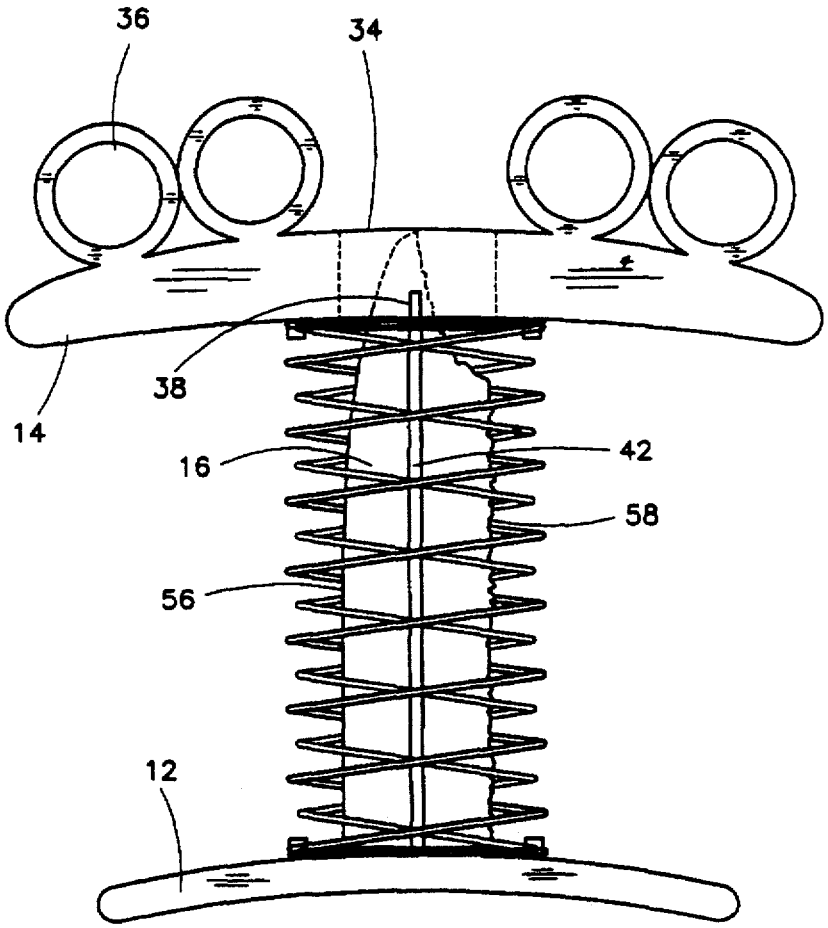

*Fig. 2*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

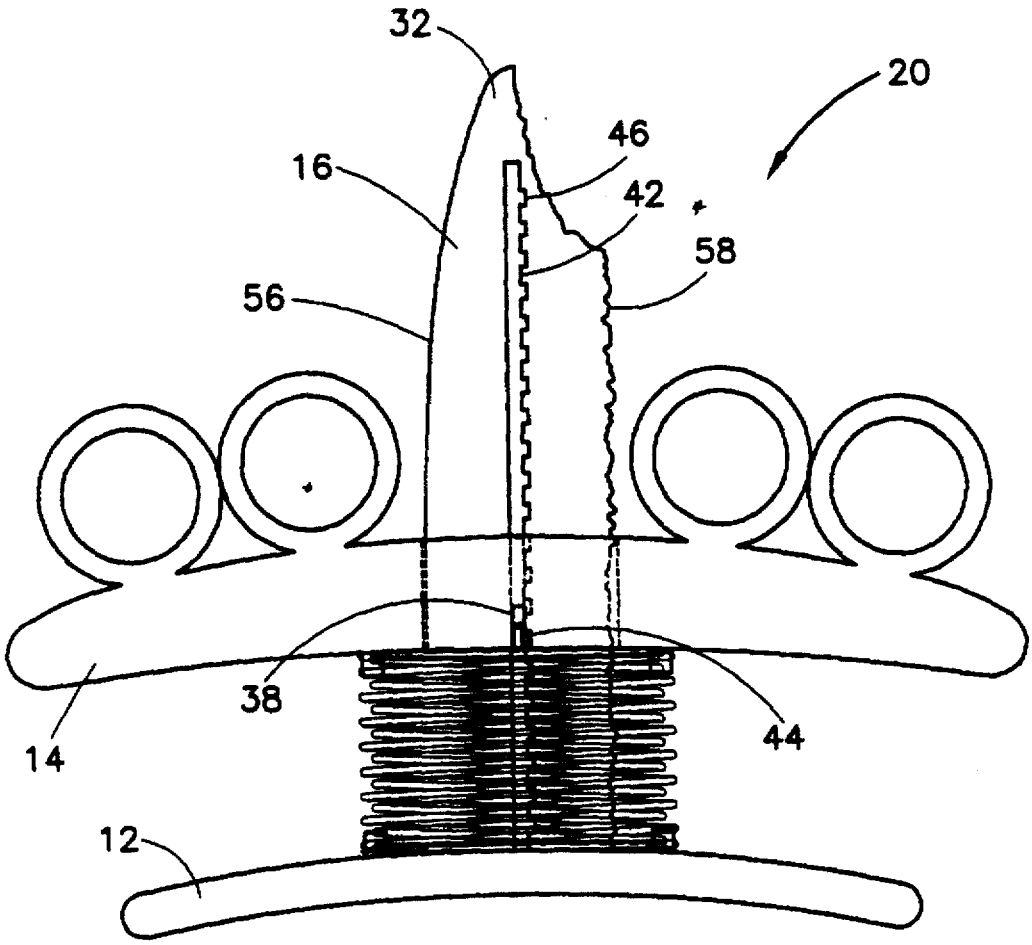

*Fig. 5*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

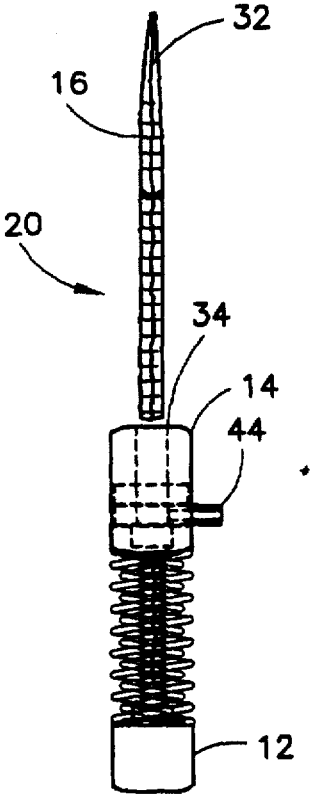

*Fig. 6*

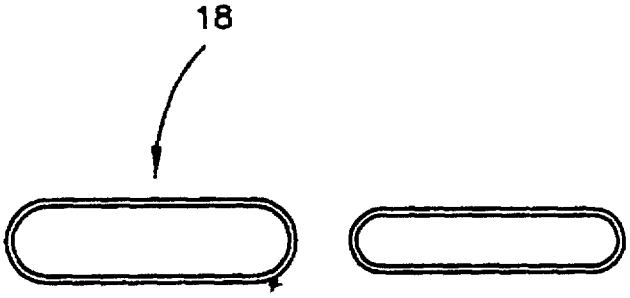

Figure 7:
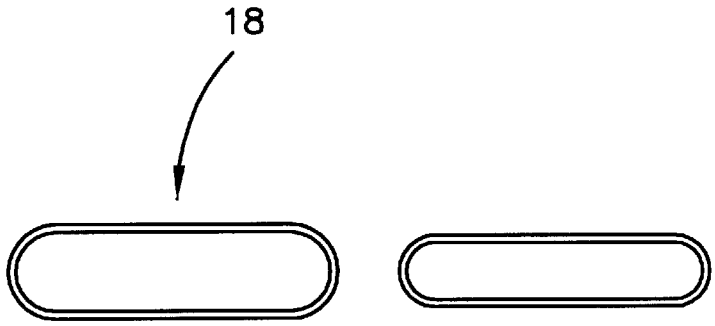
FIG. 7 is an illustration of a top view of the extension member of the first embodiment.
Figure 8:
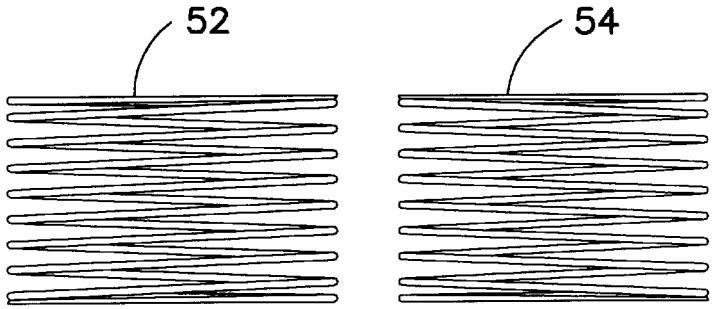
FIG. 8 is an illustration of a pair of coil springs from the extension member of FIG. 7.

*Fig. 7*

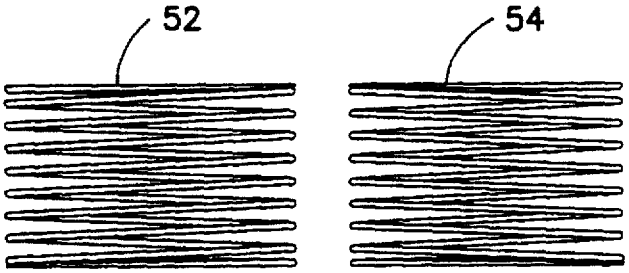

*Fig. 8*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application as follows:

Column 2,
Line 58, insert --knife-- before "blade.".

Column 3,
Line 48, delete "," after "biasing".
Line 65, delete "," after "gripping".

Column 6,
Line 35, delete,"the blade" and insert --The blade --therefor.

Column 7,
Lines 41 and 42, delete "to the first end 26 of the blade 26 allows", and insert --to the first end of the blade 16 allows --therefor.

Column 8,
Line 53, delete "farther" and insert --further -- therefor.

Column 12,
Claim 12, Number 15, delete "claim 10," and insert --claim 3,--therefor.

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

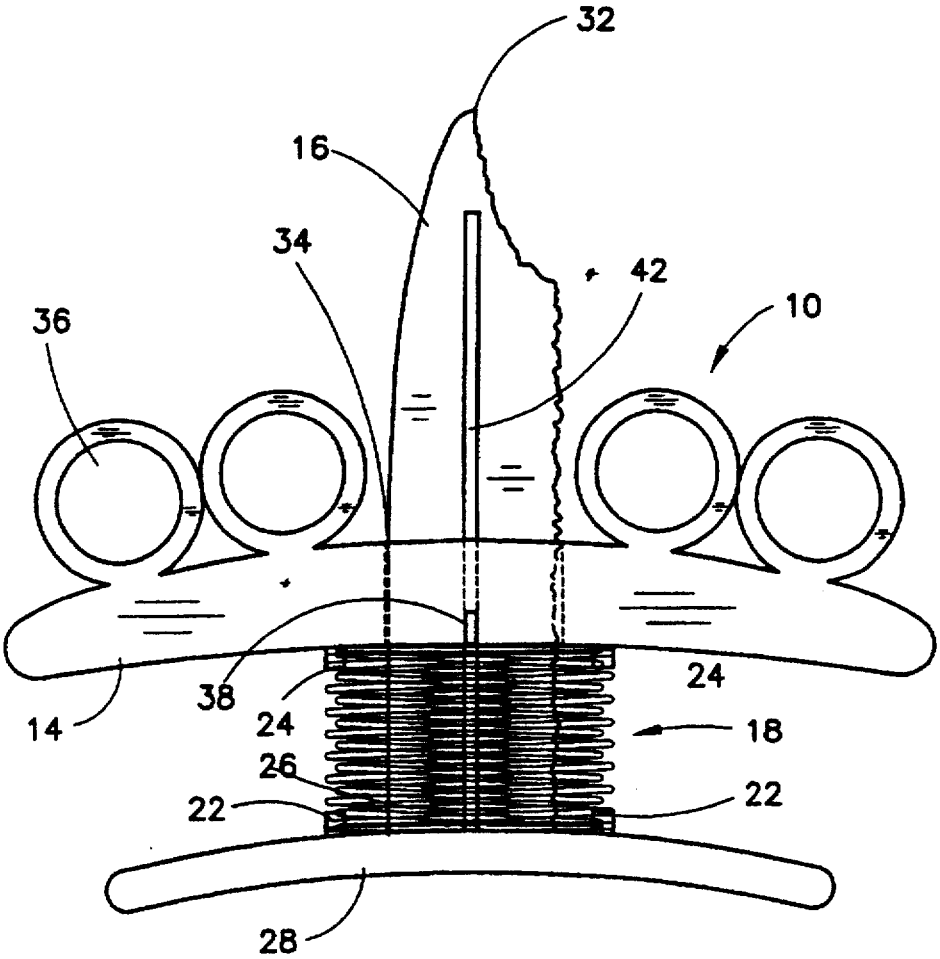

*Fig. 1*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

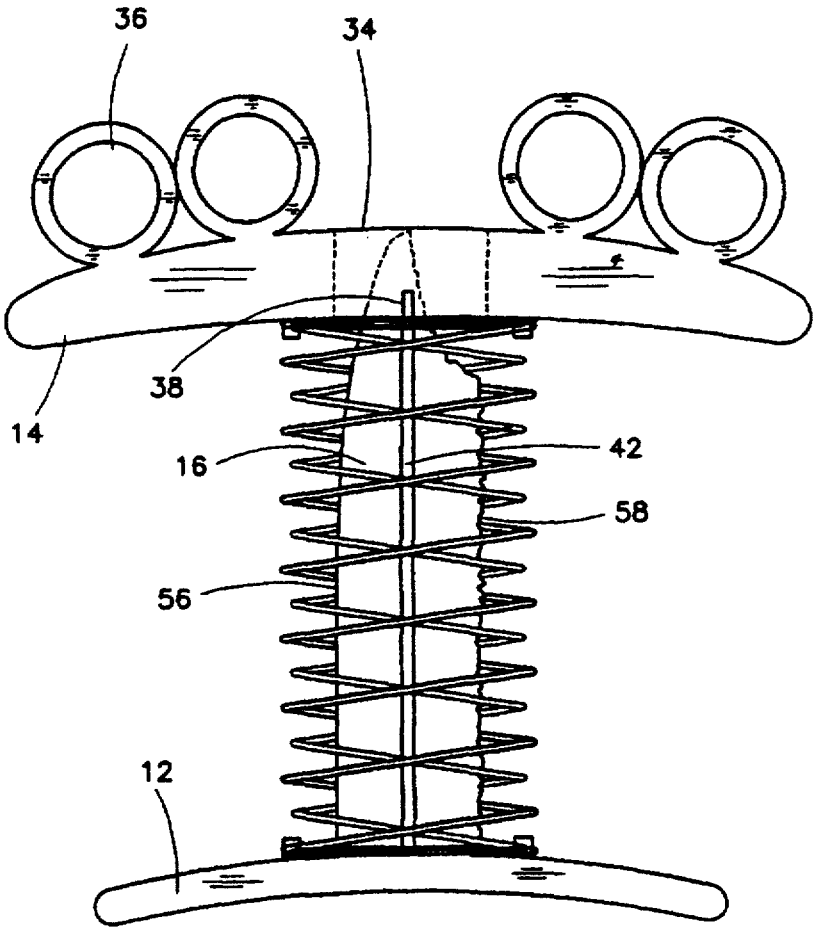

*Fig. 2*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

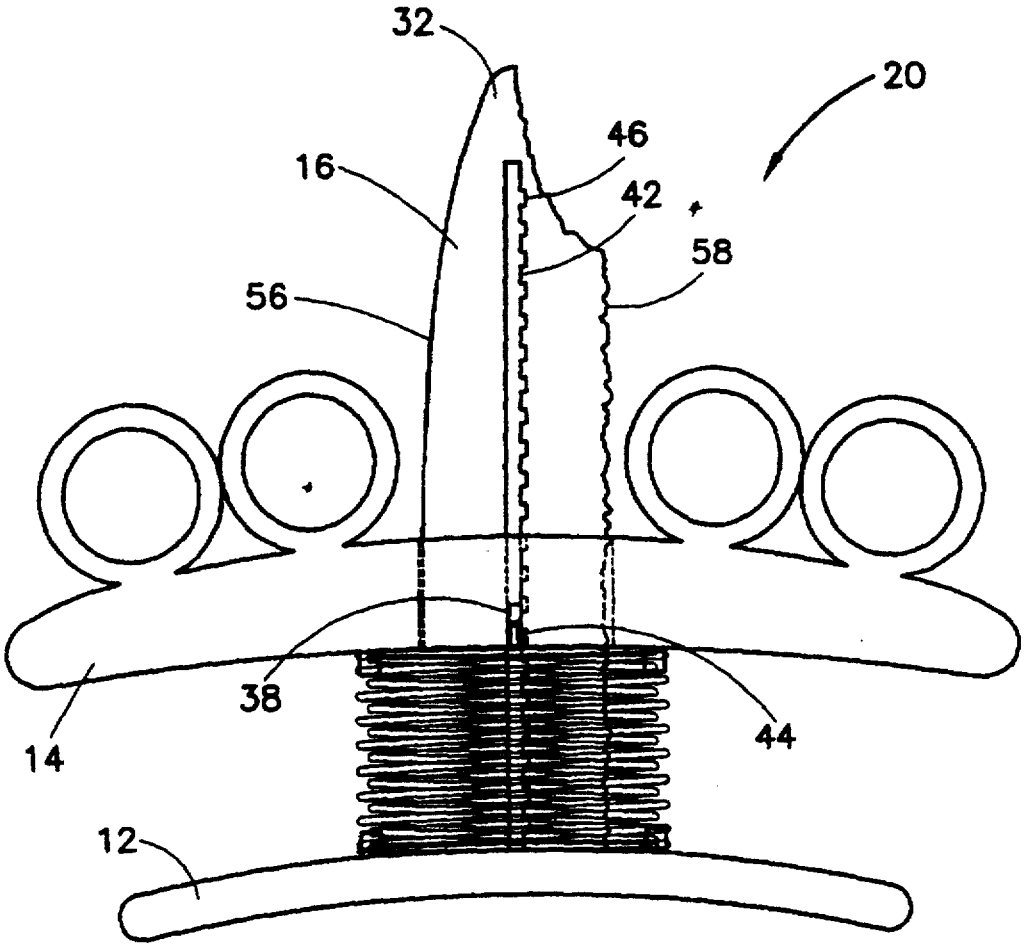

*Fig. 5*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

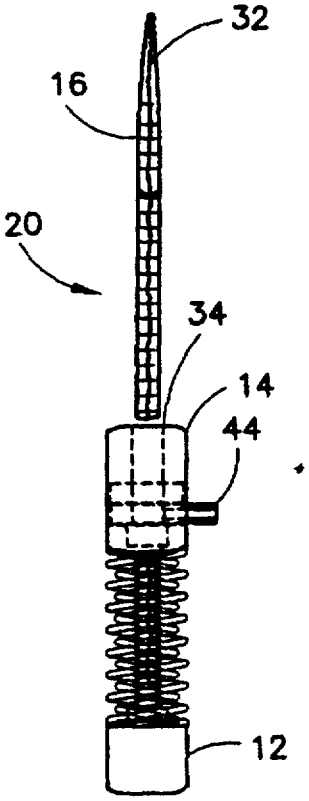

Fig. 6

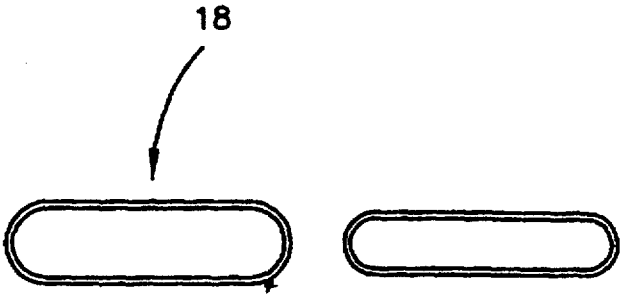

Fig. 7

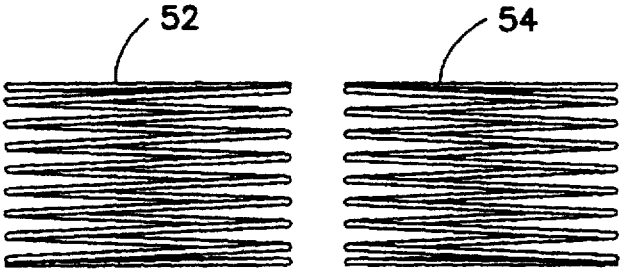

Fig. 8

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application as follows:

Column 2,
Line 58, insert -- knife -- before "blade.".

Column 3,
Line 48, delete "," after "biasing".
Line 65, delete "," after "gripping".

Column 6,
Line 35, delete,"the blade" and insert -- The blade -- therefor.

Column 7,
Lines 41 and 42, delete "to the first end 26 of the blade 26 allows", and insert -- to the first end of the blade 16 allows -- therefor.

Column 8,
Line 53, delete "farther" and insert -- further -- therefor.

Column 12, claim 15,
Line 6, delete "claim 10," and insert -- claim 3, -- therefor.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

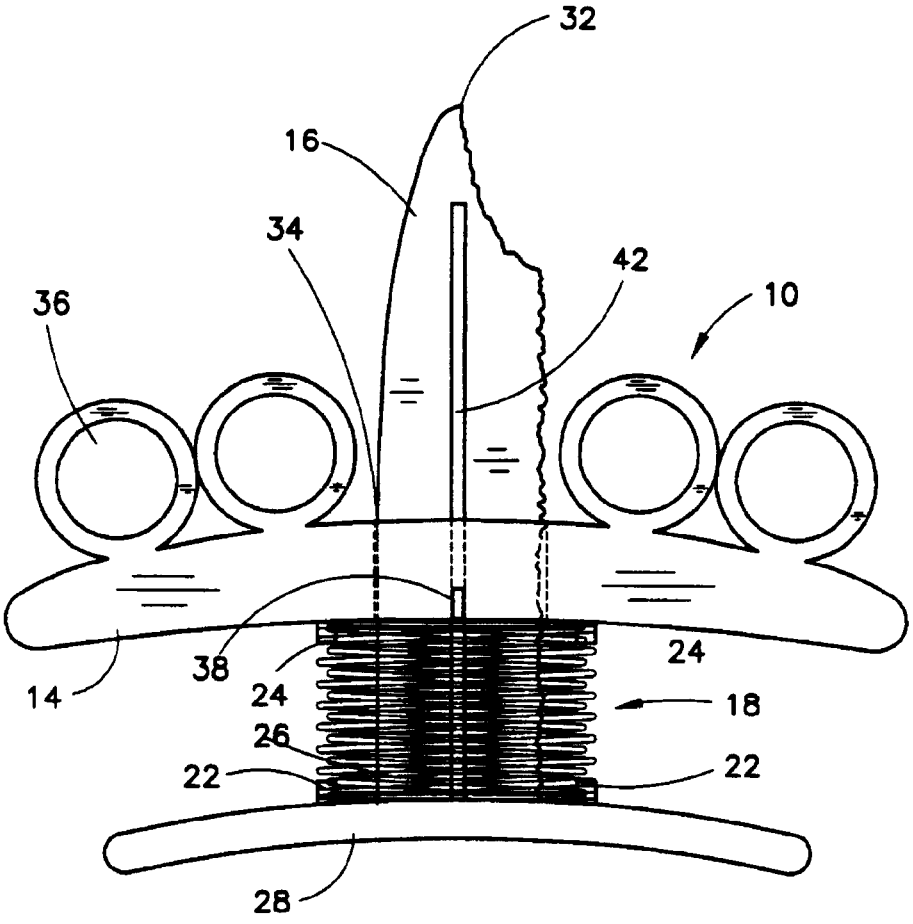

*Fig. 1*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

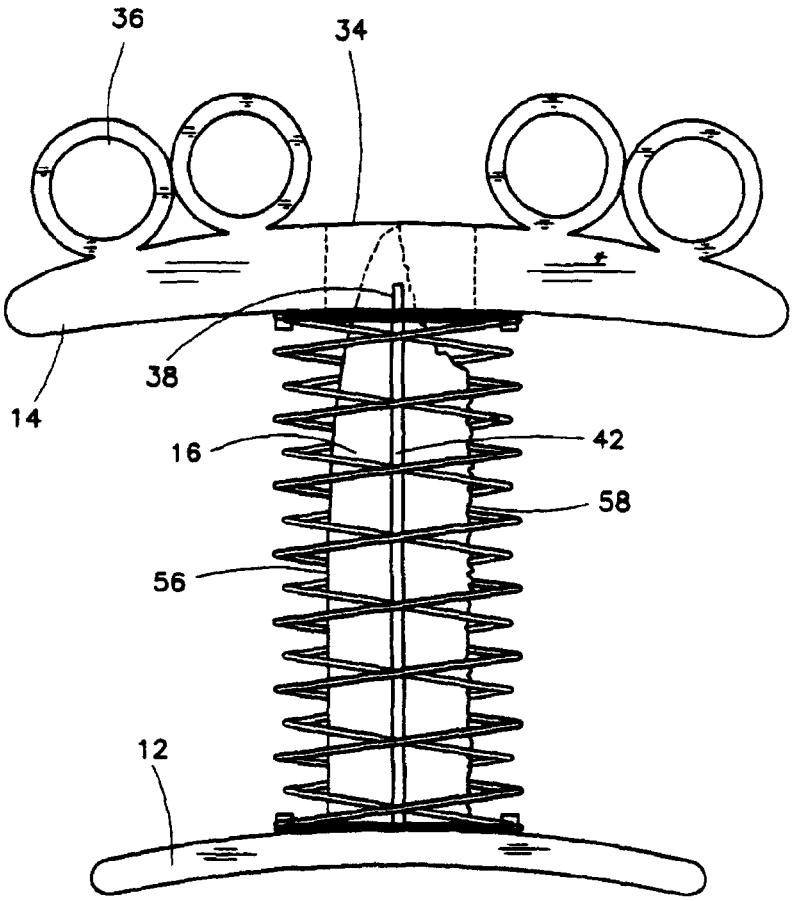

*Fig. 2*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

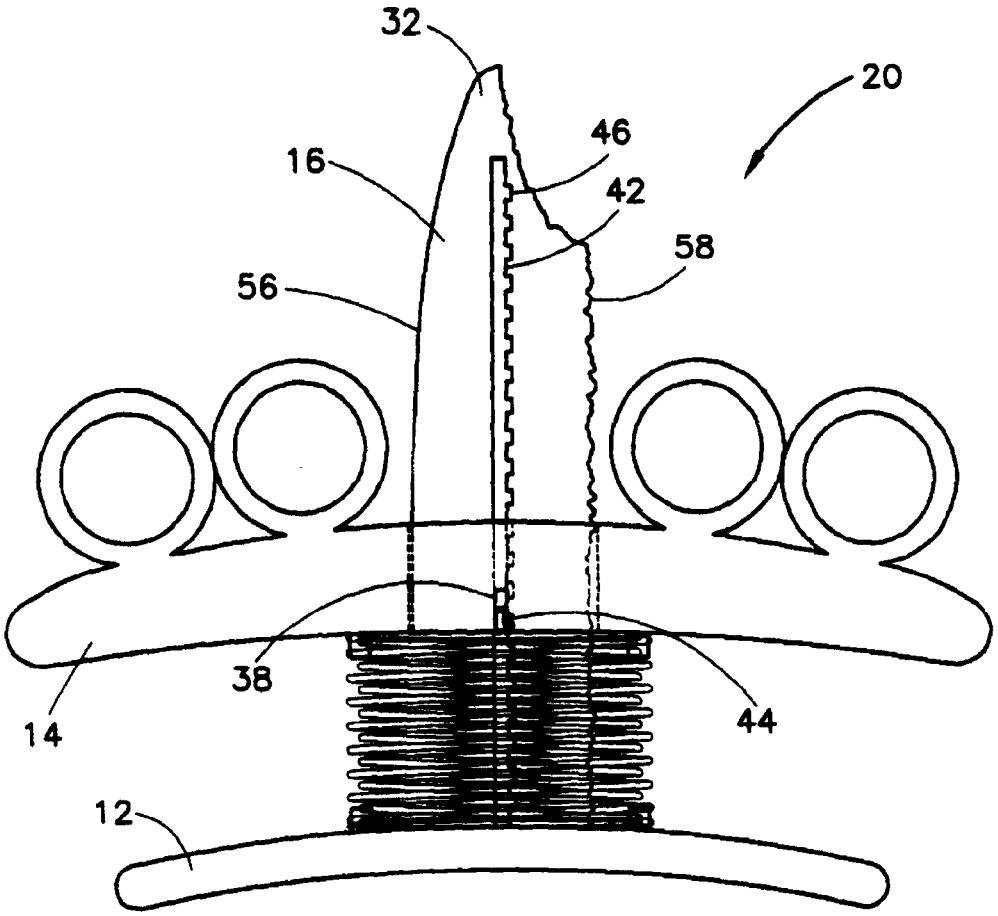

*Fig. 5*

UNITED STATES PATENT AND TRADEMARK OFFICE

CERTIFICATE OF CORRECTION

PATENT NO. : 6,122,828
DATED : September 26, 2000
INVENTOR(S) : William M. Asterino, Jr.

It is certified that error appears in the above-identified patent and that said Letters Patent is hereby corrected as shown below:

Please amend the above-listed application by substituting the following drawings:

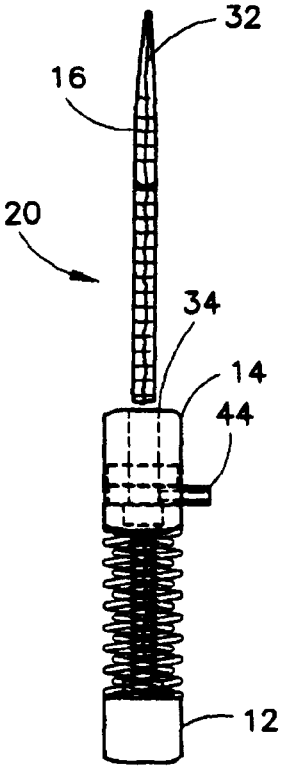

*Fig. 6*

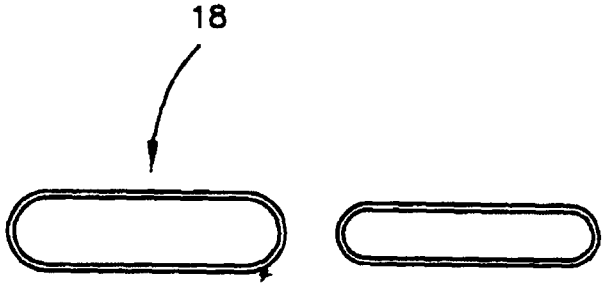

*Fig. 7*

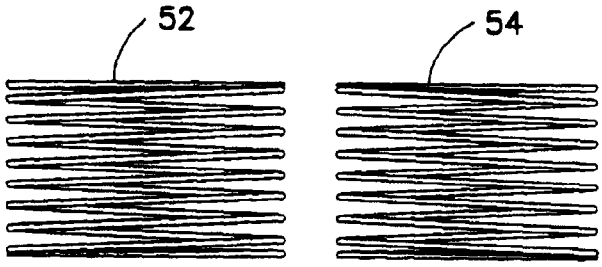

*Fig. 8*